US005496023A

United States Patent [19]

Becker et al.

[11] Patent Number: 5,496,023

[45] Date of Patent: Mar. 5, 1996

[54] LEADING EDGE STOP FOR ALIGNING PAPER SHEETS ON A FEEDER TABLE

[75] Inventors: Willi Becker, Bammental; Stefan Döpke, Eppelheim, both of Germany

[73] Assignee: Heidelberber Druckmaschinen AG, Heidelberg, Germany

[21] Appl. No.: 410,403

[22] Filed: Mar. 27, 1995

Related U.S. Application Data

[63] Continuation of Ser. No. 203,286, Feb. 28, 1994, abandoned.

[30] Foreign Application Priority Data

Feb. 27, 1993 [DE] Germany ..... 43 06 238.5

[51] Int. Cl.[6] ..... B65H 9/04

[52] U.S. Cl. ..... 271/245; 271/253; 271/255

[58] Field of Search ..... 271/243, 244, 271/245, 253, 255

[56] References Cited

U.S. PATENT DOCUMENTS

| | | | |
|---|---|---|---|
| 168,685 | 10/1875 | Tucker | 271/253 |
| 1,011,009 | 12/1911 | Bakke | 271/255 |
| 1,167,653 | 1/1916 | Nielsen | 271/253 |
| 2,069,918 | 2/1937 | Gegenheimer | 271/253 |
| 2,113,835 | 4/1938 | Gylleck . | |
| 3,081,080 | 3/1963 | Weber | 271/255 |
| 3,993,302 | 11/1976 | Weisgerber | 271/255 X |
| 4,354,673 | 10/1982 | Kuroda | 271/245 X |
| 4,402,266 | 9/1983 | Sugiyama | 271/245 X |
| 5,297,789 | 3/1994 | Filsinger et al. | 271/245 |

FOREIGN PATENT DOCUMENTS

| | | |
|---|---|---|
| 0374496 | 6/1990 | European Pat. Off. . |
| 944373 | 5/1956 | Germany . |

*Primary Examiner*—William E. Terrell
*Assistant Examiner*—Carol L. Druzbick
*Attorney, Agent, or Firm*—Herbert L. Lerner; Laurence A. Greenberg

[57] ABSTRACT

A combination is provided on a feeder table of a sheet-processing machine, which includes a front lay member cyclically swivelable about an axis, in accordance with a sheet-conveying cycle, and a leading-edge stop for effecting an alignment of paper sheets, the leading-edge stop being disposed on and swivelable with the front lay member out of an alignment position, into a rest position and back into the alignment position, the leading-edge stop including an adjustment device for adjustably fastening the leading-edge stop in a respective position thereof in a conveying and counter to a conveying direction, respectively, of the paper sheets with respect to the front lay member in the alignment position of the front lay member for engaging and disengaging the alignment of the paper sheets by the leading-edge stop.

13 Claims, 6 Drawing Sheets

LEADING EDGE STOP FOR ALIGNING PAPER SHEETS ON A FEEDER TABLE

Figure 1A:
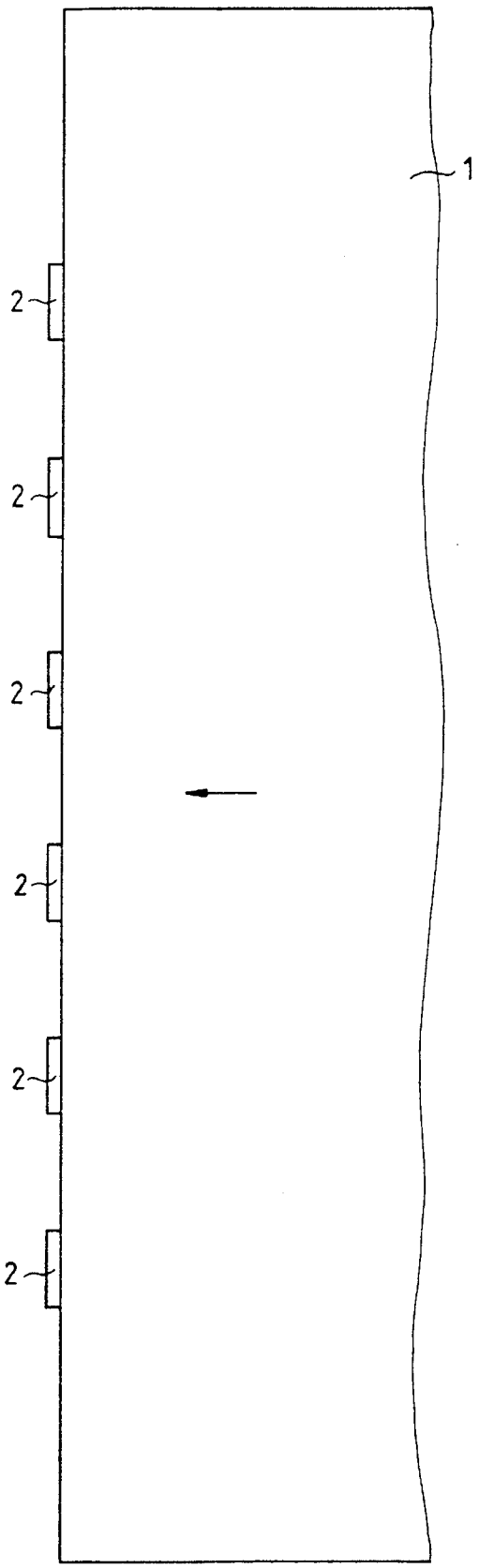

This application is a continuation of application Ser. No. 08/203,286, filed Feb. 28, 1994 now abandoned.

SPECIFICATION

The invention relates to a leading edge aligning stop for aligning paper sheets and the like on a feeder table of a sheet-processing machine, such as a printing press, especially.

It has become known heretofore to align paper sheets, which are conveyed over a feeder table of a paper-sheet processing machine, at leading-edge aligning stops of a front lay device distributed transversely over the width or breadth of the respective sheets. In this regard, several leading-edge stops are conventionally arranged on one or more front lay members which are swiveled cyclically, in accordance with the conveyor cycle for the sheet conveyance, about a common swivel axis extending transversely to the sheet conveying direction, in a manner that the leading edge stops penetrate into the sheet conveying plane, so that the oncoming paper sheets are aligned by their leading edge against the leading-edge stops and, after the sheets have been aligned, the front lay members are again swiveled away out of the conveying plane. The selection of the disengagement or disconnection of the individual leading-edge stops thus depends upon the type of paper, upon the paper sheet format or size and upon individual wishes of the pressman or other operating personnel. Conventional leading-edge stops are thereby formed with additional adjusting means acting via a costly adjusting mechanism on the leading-edge stops. Fine adjustments, for example, for only slight shut-down or disengagement of a single leading-edge stop are conditionally possible only with additional effort for such leading-edge stops. Such a slight shut-down or disengagement of a leading-edge stop may be necessary, for example, in the case of very thin paper sheets, for which only two outer leading-edge stops optimally selected for the respective sheet format have been engaged, at which the paper sheet is aligned and between which one or more leading-edge stops have been engaged only so slightly that they merely represent an additional support of the sheet leading edge without having any effect upon the leading-edge alignment.

It is accordingly an object of the invention to provide a leading-edge stop for aligning paper sheets on a feeder table of a sheet-processing machine, such as a printing press especially, the leading-edge stop being arranged on and swivelable with a front lay member cyclically swivelable about an axis, in accordance with a sheet-conveying cycle, into a rest position and back into an alignment position, the leading-edge stop being adjustably fastened in the position thereof by adjustment means in the conveying and counter to the conveying direction, respectively, of the paper sheets with respect to the front lay member in the alignment position thereof for engagement and disengagement of the alignment function of the leading-edge stop, which is of relatively simple construction, so that it, nevertheless, can be engaged and disengaged with relatively slight effort.

With the foregoing and other objects in view, there is provided, in accordance with the invention, on a feeder table of a sheet-processing machine, the combination comprising a front lay member cyclically swivelable about an axis, in accordance with a sheet-conveying cycle, and a leading-edge stop for effecting an alignment of paper sheets, the leading-edge stop being disposed on and swivelable with the front lay member out of an alignment position, into a rest position and back into the alignment position, the leading-edge stop comprising adjustment means for adjustably fastening the leading-edge stop in a respective position thereof in a conveying and counter to a conveying direction, respectively, of the paper sheets with respect to the front lay member in the alignment position of the front lay member for engaging and disengaging the alignment of the paper sheets by the leading-edge stop. By the fact that the leading-edge stop itself is or includes the adjusting means, additional adjusting means are dispensed with. By minimizing the components and the displaced parts, a simpler, more economical leading-edge stop is possible. Transfer or transmission losses between the adjusting means and the leading-edge stop vanish. Making ready additional structural space for additional adjusting means is thus unnecessary.

In accordance with another feature of the invention, the leading-edge stop has an axially symmetric construction and is mounted in the front lay member so as to be rotatable about the axis of symmetry thereof, and including on the leading-edge stop and the front lay member corresponding deflecting elements for producing a translatorial displacement of the leading-edge stop in direction of the axis due to rotation about the axis. This permits a functionally efficient, simple and economic construction of the leading-edge stop, with relatively easy adjustability for engaging and individually disengaging leading-edge stops.

In accordance with a further feature of the invention, the front lay member is formed with a stop for limiting an adjustment path of the leading-edge stop with respect to the front lay member in the direction counter to the conveying direction, the leading-edge stop, in the alignment position of the front lay member being in the engaged position for aligning the leading edge of the sheet, when the leading-edge stop is in engagement with the stop formed on the front lay member. This permits the especially simple reproduction of the engagement condition of a leading-edge stop. The pressman or other operator can disengage the leading-edge stop by simply turning the leading-edge stop individually partly or entirely. To produce the exactly defined alignment condition of the leading-edge stop, it is sufficient to turn the leading-edge stop in the opposite direction until it stops at the front lay member. The exact alignment condition is thus simply producible without any additional measurement, adjustment or any other auxiliary devices.

In accordance with an added feature of the invention, the axially symmetrical leading-edge stop has a peripheral surface formed with regions for introducing force for effecting a rotational adjustment. This permits a relatively simple adjustability of the leading-edge stop. Especially advantageous is the construction of the outer peripheral surface with static-friction regions, due to which a simple manual adjustment which is reliable and sensitive is afforded.

Especially simple, economical and reliable is the construction of the friction surfaces as knurled or rubber-covered regions.

In accordance with an additional feature of the invention, the axially symmetrical leading-edge stop has a peripheral surface formed with static friction surface regions.

In accordance with yet another feature of the invention, the static friction surface regions are selected from the group consisting of knurled and rubber-covered surface regions.

In accordance with yet a further feature of the invention, the leading-edge stop is a head of a screw formed with an external thread corresponding to an internal thread formed in the front lay member.

In accordance with yet an added feature of the invention, the leading-edge stop is formed as a pin, one of the leading-edge stop and the front lay member being formed with an axial cam, and the other of the leading-edge stop and the front lay member having a cam-follower element corresponding to the axial cam.

In accordance with yet an additional feature of the invention, the leading-edge stop is a nut formed with an internal thread, and including an external screw thread formed on the front lay member, the internal thread corresponding to the external screw thread.

The latter three features of the invention provide for preferred, especially simple and functionally efficient desirable embodiments of a leading-edge stop. If the threads and the axial cam, respectively, are formed with a slight pitch, for example, as a fine thread, a sensitive adjustment and a reinforced automatic locking are additionally achievable.

In accordance with still another feature of the invention, the leading-edge stop is formed with profiling for engagement by a tool. This permits an additional adjustability not only manually, but also by means of tools. Such a leading-edge stop is universally applicable. It can be installed without any special effort on the most varied presses or sheet-processing machines with different customer requirements. It permits a simple manual adjustment by engagement from the outside on the periphery of the leading-edge stop or, for example, through openings in the conveyor or feeder table or from a side of the press by means of manual tools or even the connection of remotely controlled tools for remotely adjusting the front lays.

In accordance with still a further feature of the invention, the leading-edge stop is formed with means four axial position determination. This permits an exact individual adjustment of the leading-edge stop.

In accordance with still an added feature of the invention, means are provided for guiding over the leading-edge stop a respective paper sheet pulled from the feeder table. This permits an especially reliable application of the leading-edge stop without any danger of damage to the last paper sheet aligned at the leading edge thereof and conveyed over the region of the front lay to a paper sheet-processing unit.

In accordance with still an additional feature of the invention, the combination includes a cover lay fastened on the front lay member in vicinity of the leading-edge stop, the cover lay being formed with a sheet-guiding surface for guiding over the leading-edge stop a respective paper sheet pulled from the feeder table, the cover lay being formed with a pass-through opening providing access for adjusting the leading-edge stop.

In accordance with another feature of the invention, the guiding means include at least one sheet-guiding roller.

The last two features provide a construction which is especially advantageous, simple and reliable.

In accordance with a concomitant feature of the invention, the leading-edge stop is a sliding element, and corresponding deflecting elements are included on the front lay member and on the leading-edge stop for producing a translatorial displacement component of the leading-edge stop in the sheet conveying direction.

Other features which are considered as characteristic for the invention are set forth in the appended claims.

Although the invention is illustrated and described herein as embodied in a leading-edge stop for aligning paper sheets on a feeder table, it is nevertheless not intended to be limited to the details shown, since various modifications and structural changes may be made therein without departing from the spirit of the invention and within the scope and range of equivalents of the claims.

Figure 1B:
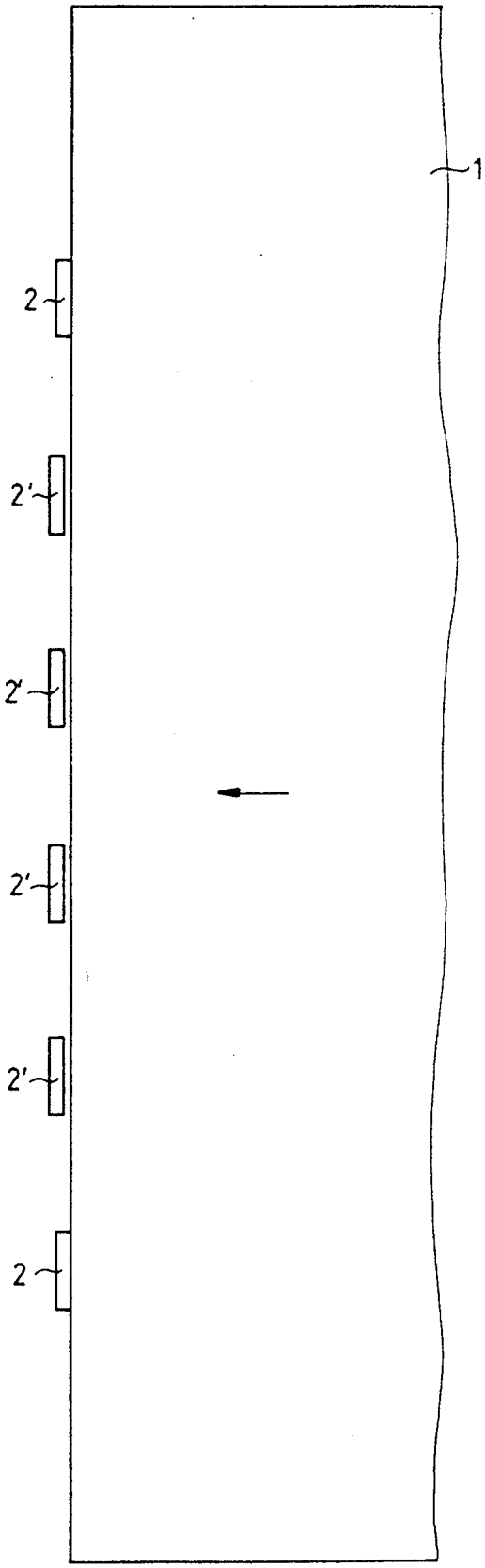

The construction and method of operation of the invention, however, together with additional objects and advantages thereof will be best understood from the following description of specific embodiments when read in connection with the accompanying drawings, in which:

FIG. 1*a* and 1*b* are diagrammatic top plan views of an embodiment of the invention wherein six front lays are distributed over the width or breadth of a feeder table transversely to a paper-sheet conveying direction, the paper sheet being in engagement with all six front lays in FIG. 1*a*, and being disengaged from four of the six front lays in FIG. 1*b;*

Figure 2B:
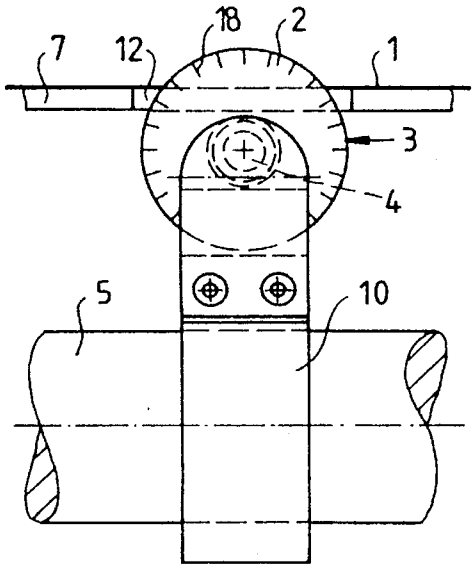
Figure 2A:
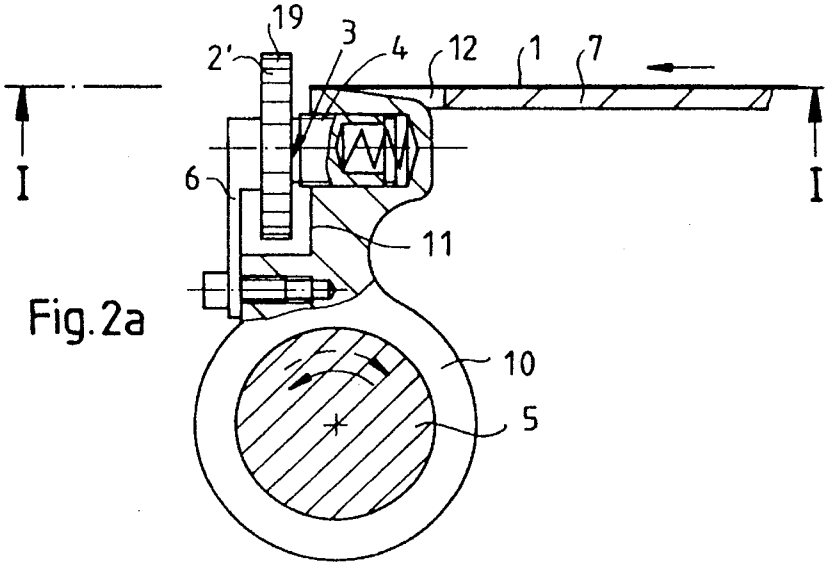
Figure 2C:
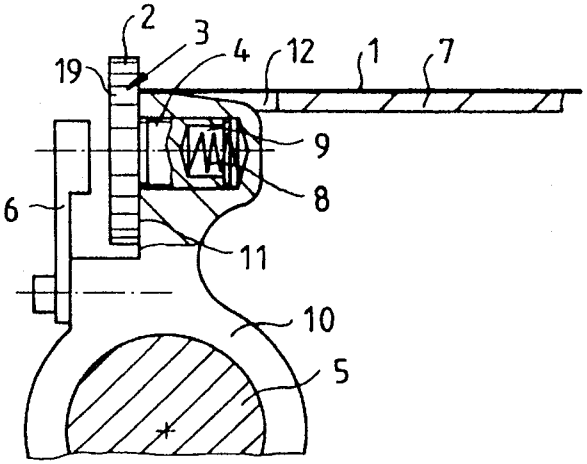
Figure 3B:
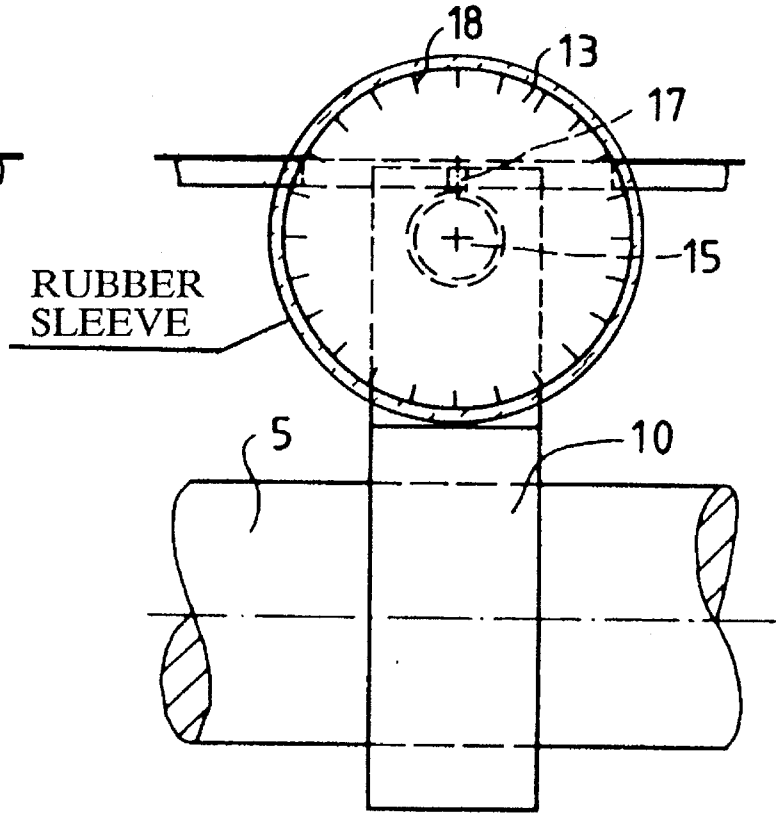
Figure 3A:
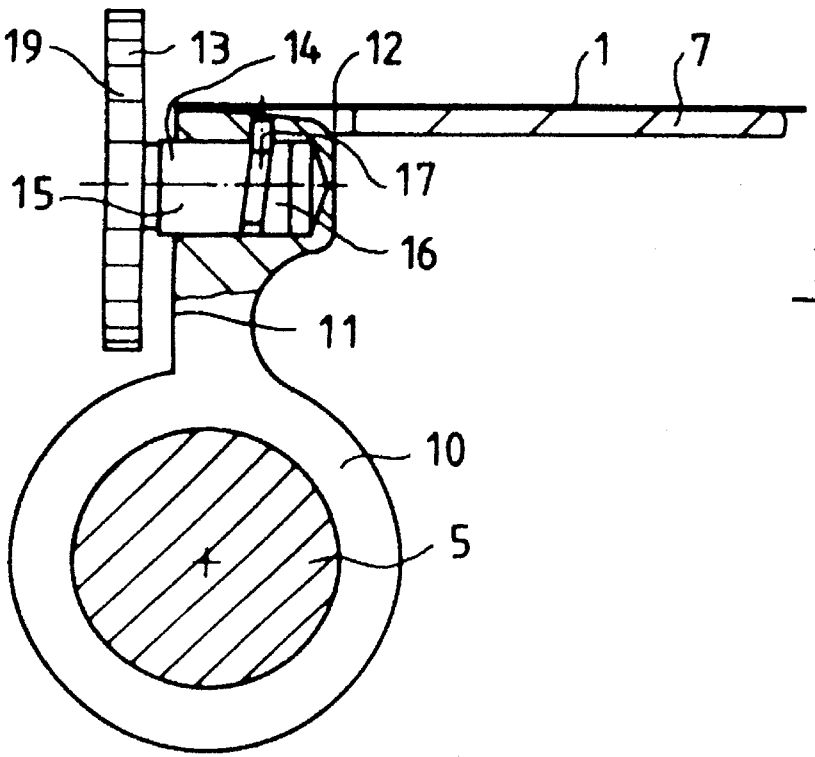
Figure 4B:
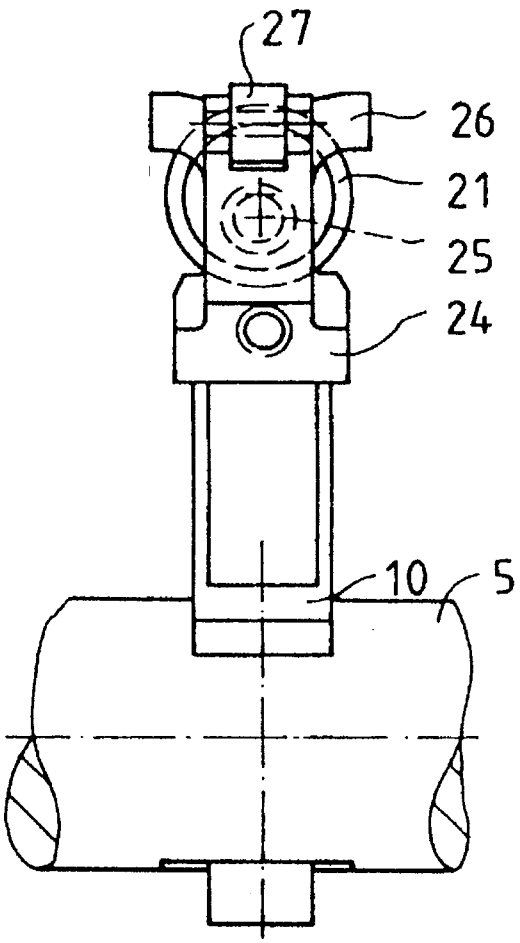
Figure 4A:
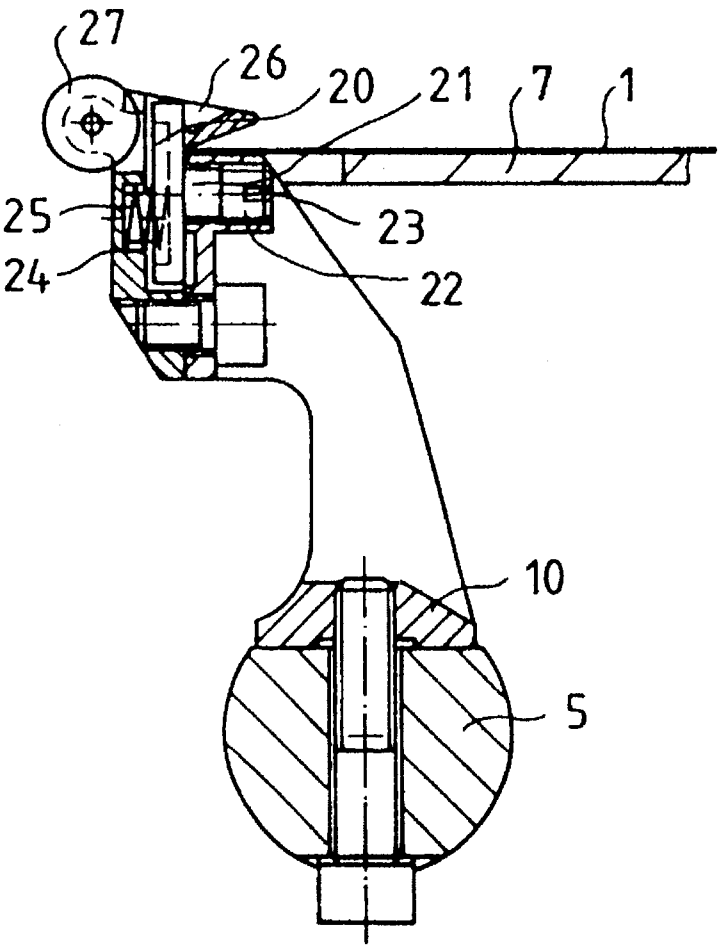
Figure 5B:
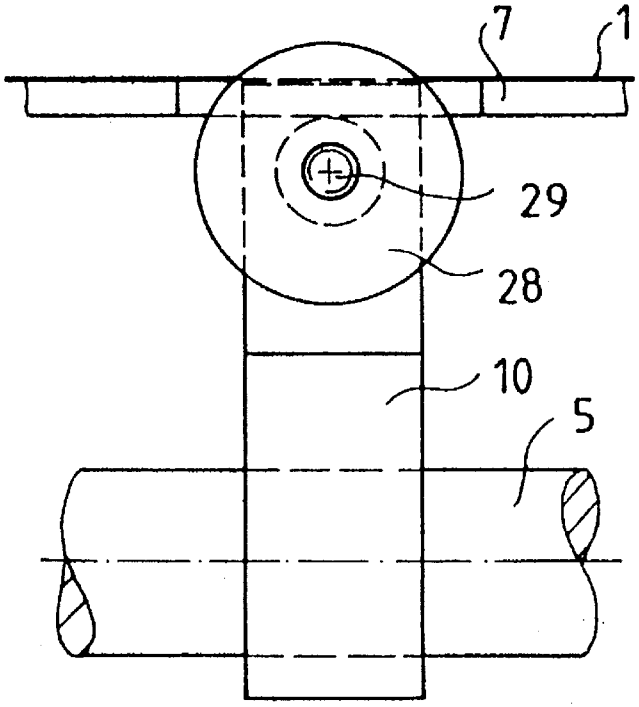
Figure 5A:
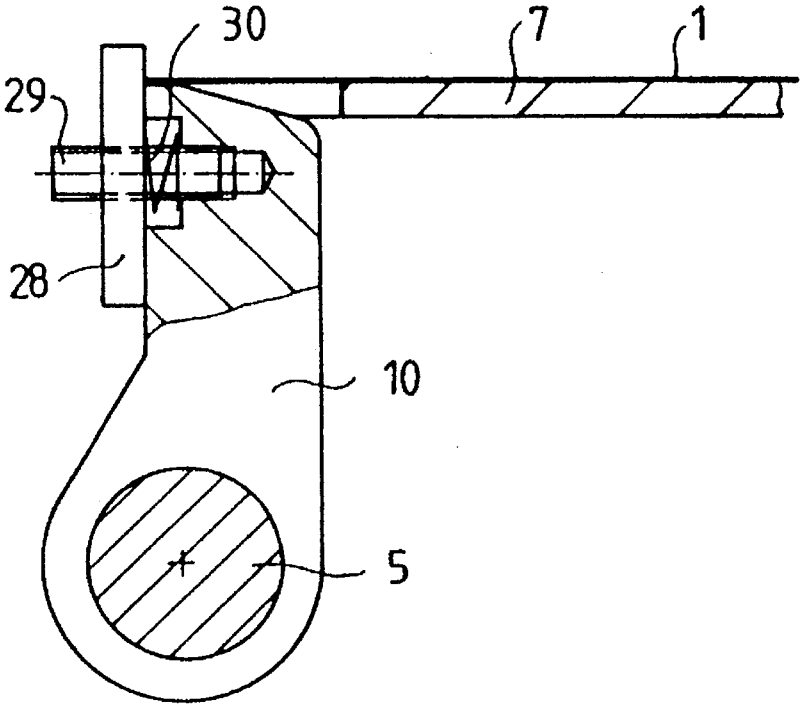
Figure 6:
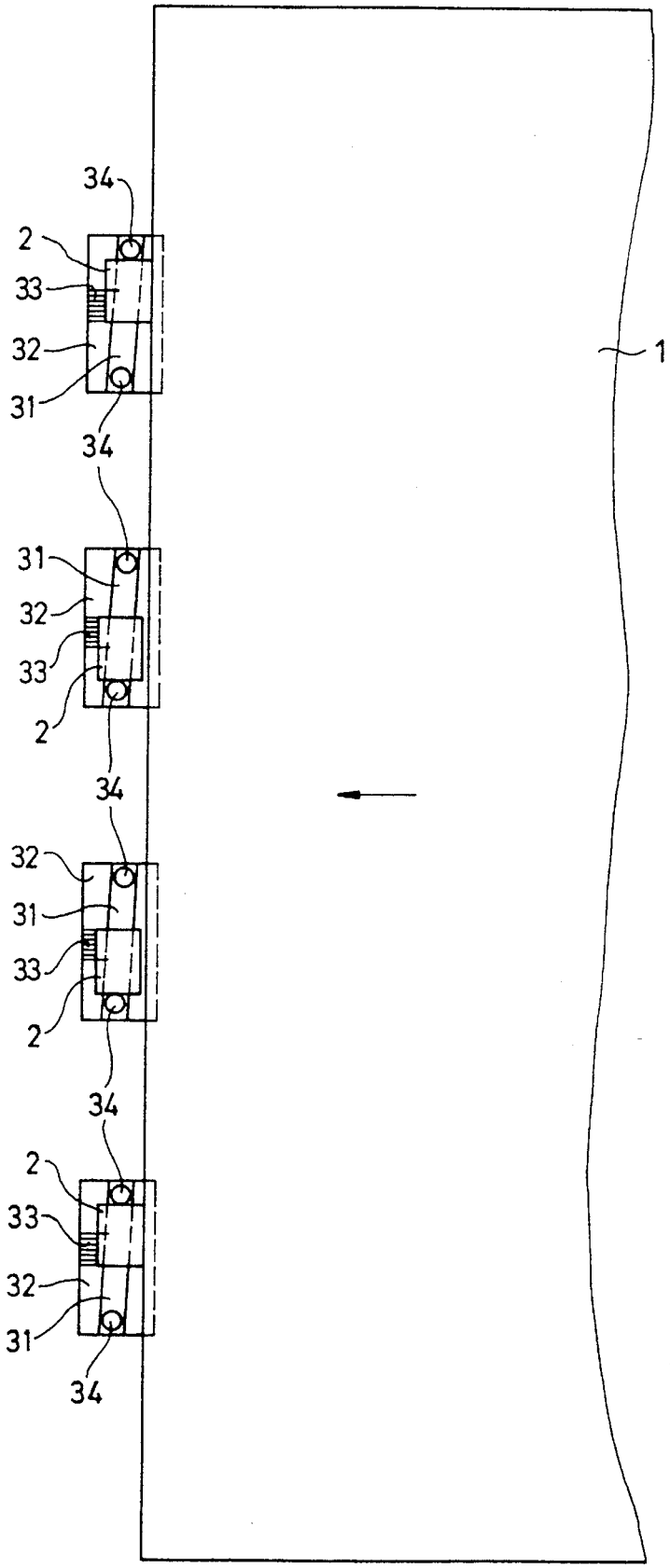

FIGS. 2*a* and 2*b* are respective side and front elevational views of an embodiment of the front lay stop according to the invention which is formed as a screw;

FIG. 2*c* is a view like that of FIG. 2*a* in another operating phase thereof;

FIGS. 3*a* and 3*b* are views like those of FIGS. 2*a* and 2*b*, rerspectively, of another embodiment of the invention, wherein the front lay stop is formed as a pin with an axial groove;

FIGS. 4*a* and 4*b* are side and rear elevational views of a third embodiment of the invention formed with an additional profile for engagement by a tool;

FIGS. 5*a* and 5*b* are views like those of FIGS. 2*a* and 2*b*, respectively, for example, of a fourth embodiment of the invention, wherein the front lay stop is formed as a nut; and FIG. 6 is a view like that of FIG. 1*a* of a fifth embodiment of the invention.

Referring now to the drawings and, first, particularly to FIG. 1*a*, 1*b*, 2*a* and 2*b* thereof, there is shown therein part of a feeder table 7 of a sheet-fed rotary printing press wherein a paper sheet 1, in accordance with the arrow associated therewith, is conveyed from the right-hand to the left-hand sides of FIG. 1*a*, 1*b* and 2*a* over the feeder table 7 in a conventional manner by conventional non-illustrated conveyor means into a region for aligning the paper sheet 1 along the leading edge of the sheet. For performing the alignment, the paper sheets 1 are conveyed so that the leading edge thereof engage respective screw heads 2 of screws 3 distributed symmetrically to the middle of the feeder table 7 transversely to the conveying direction of the sheets 1. The leading edge of the sheets 1 thus engages the screw heads and thereby aligns itself. The respective screws 3 are screwed with the thread 4 thereof into a respective front lay member 10. The thread 4 is a fine thread. The screw 3 is formed with a blind bore 9 in an end thereof wherein a spring 8 is received which, at one side, is braced against the screw 3 and, at the other side, against the front lay member 10 and thereby applies a prestressing or loading to the screw 3 for improving automatic locking thereof and for overcoming play. The front lay members 10 are fastened to a common front lay shaft 5 so that the axes of the screws 3 are disposed in a common plane and so that stop surfaces 11 formed on the front lay members 10 for limiting the adjusting path of each of the screws 3 lie in a common plane.

For the purpose of alignment, the paper sheets 1 are conveyed over the feeder table 7 from the right-hand towards the left-hand sides of FIG. 1*a*, 1*b* and 2*a* until the leading edge thereof engages the screw heads 2 and the sheets 1 are aligned thereon. The respective paper sheets 1 are then taken up by following conveyor means in a conventional manner. Thereafter, the front lay member 10 and, accordingly, the screw heads 2 are swiveled in the sheet conveying direction by the swiveling of the front lay shaft 5 in a conventional manner, in the direction represented by the curved solid-line arrow in FIG. 2*a*, until the the screw head 2 is located below the sheet conveying plane. The paper sheet 1 is conveyed by the conveying means over the screw head 2 in the aligned condition thereof to a first printing unit. The front lay shaft 5 then swivels back again into the starting position thereof, in the direction represented by the curved broken-line arrow in FIG. 2*a*, until the stop surface 11 of the front lay shaft 5 is again disposed perpendicularly to the sheet conveying direction.

The pressman can screw in place individual screw heads 2 into the aligning position, i.e., the position in which the screw head 2 engages the stop surface 11 formed on the front lay member 10, according to FIG. 2*c*, in accordance with a sheet format or size to be printed or a type or thickness of the paper to be printed or in accordance with any other individual criterion. All of the thus engaged screw heads 2 are thus located on a common line, as shown in FIG. 1*a*, for example. FIG. 1*a* shows the alignment of a sheet 1 on six screw heads 2 engaged for alignment. In FIG. 1*b*, the four inner screw heads 2' assume a disengaged position in comparison with the view of FIG. 1*a*, As shown in FIG. 2*a*, it is conceivable to fasten a stop 6 onto the front lay member 10 for limiting the path or travel of the screw 3. The screw head 2 can thus be positioned individually for engaging or disengaging between the stop 6 and the stop surface 11. It is conceivable, for example, in the case of especially thin paper sheets, to disengage individual inner screw heads 2' only minimally, as shown in FIG. 1*b*, so that a supporting engagement remains possible, however, the required application of force for alignment of the paper sheet 1 is effected exclusively by the heads 2 of the engaging outer screws 3. For individual exact adjustment, as shown in FIG. 2*b*, a scale 18 is applied to an end face of the screw head 2, by means of which the operating pressman can accurately define the adjustment path or travel of the screw 3. Obviously, it is also conceivable to provide, on the front lay member 10 or on the stop 6, an additional marking, such as a notch or pointer, for example, by the aid of which the adjustment may be made even more exactly. A knurl 19 is formed at the periphery of the screw head 2 for improving the gripping capability thereof for adjusting the screw head 2. Instead of a knurl, other measures for improving the ability to grip the screw head 2 are conceivable, such as to cover the periphery of the screw head 2 with rubber, for example.

FIGS. 3*a* and 3*b* illustrate an embodiment of the invention wherein paper sheets 1 are aligned on rotationally or axially symmetrical pin heads 13 of pins 14 which have a cylindrical pin body 15 rotatably and axially displaceably mounted in the respective front lay members 10. Each pin body 15 is formed with a peripheral groove 16 representing an axial cam wherein a guide pin 17 fastened to the front lay member 10 engages. By turning or twisting the pin head 13, the pin 14 is translatorially shifted axially in and opposite to the conveying direction, respectively, due to the engagement of the guide pin 17 in the peripheral groove 16. The pin heads 13 individually employed in the aligning process, are adjusted so that they, as in the embodiment of FIGS. 2*a*, 2*b* and 2*c*, are in engagement with the stop surface 11 of the front lay member 10.

In FIGS. 4*a* and 4*b*, there is shown an embodiment of the invention wherein also screw heads 20 of screws 21, respectively, are screwed in place into respective front lay members 10 which, as in the preceding embodiments, are fastened onto a shaft 5. Each of the screws 21 is formed with a thread 22 by which it is screwed into an internally threaded through-bore formed in a respective front lay member 10. The screw 21 is formed with a slot 23 in an end thereof located opposite to a screw head 20 thereof. The slot 23 is provided so that it may be engaged by a screwdriver for turning the screw 21. It is also conceivable that the screw end opposite the screw head 20 may be provided with suitable profiles corresponding to other tools, or that a remotely-controlled tool may be used for engaging with the screw end.

The screw head 20 is subjected to pretensioning by a spring 25 located between a sheetmetal cover or cover plate 24 and the screw head 20.

As shown in FIG. 4, the cover plate 24 may also be part of a cover lay 26 having an upper edge by which it extends above the screw head 20. The paper sheets 1 aligned at the screw head 20 are conveyed away over the cover lay 26 and the screw head 20 by conventional conveyor means after the front lay member 10 has been swiveled away. The cover lay 26 thus permits a reliable sliding of the sheet conveyed away over the cover lay 26 without engagement of the screw head 20 by the paper sheet 1. It is also conceivable to rotatably mount a sheet guide roller 27 additionally in the cover lay 26 so that the paper sheet 1 lies for the most part on this sheet guide roller 27 and rolls off thereon. Damage to the paper surface is thus widely excluded due to the sliding action.

FIG. 5 shows an embodiment of the invention wherein a paper sheet 1 is aligned at screw nuts 28 which, respectively, are screwed on a threaded pin 29 fastened into front lay members 10. A compression spring 30 is disposed between the screw nut 28 and the front lay member 10 for applying a spring load or prestressing force.

Additional stop limits, as represented by the stop 6 in the embodiment of FIGS. 2*a*, 2*b* and 2*c*, are obviously also conceivable for the other embodiments of the invention. Likewise, the screw nut 28 as well as the pin head 19 and the screw head 21 may also be formed with a knurl or corrugations or with a covering of rubber, for example, in accordance with the embodiment of FIGS. 2*a*, 2*b* and 2*c*, for improving gripping capability. Moreover, measures for accurate adjustment in accordance with the scale 18 of FIG. 2*b* are also conceivable for the other embodiments of the invention.

FIG. 6 is a diagrammatic view of an embodiment of the invention wherein leading-edge stops 2 are displaceably mounted by a lower region thereof in a guide groove 31 formed in bodies 32 fastened below the sheet conveying plane, the guide groove 31 extending transversely to the sheet conveying direction. By means of displacement projections 33, the leading-edge stops 2 can be shifted or slid play-free, preferably spring-aided, laterally between limit pins 34 in the guide groove 31, the position thereof in the sheet conveying direction likewise in the intended slight adjustment range being varied, and possibly being readable from a non-illustrated scale. Suitable surface shape or design as well as the slight pitch of the guide groove 31 in the sheet conveying direction permit an automatically locking reliable adjustment without any possible unintentional adjustment due to oncoming sheets during the operation.

We claim:

1. On a feeder table of a sheet-processing machine, the combination comprising a front lay member cyclically swivelable about an axis, in accordance with a sheet-conveying cycle, and leading-edge stops for effecting an alignment of paper sheets, said leading-edge stops being disposed on and swivelable with said front lay member out of an alignment position, into a rest position and back into said alignment position, each of said leading-edge stops being adjustment means for adjustably fastening said respective leading-edge stop in a respective position thereof in a conveying and counter to a conveying direction, respectively, of the paper sheets with respect to said front lay member in said alignment position of said front lay member, said adjustment means including a sheet abutting surface formed on each of said leading-edge stops, each of said leading-edge stops having an axially symmetric construction and being mounted in said front lay member so as to be rotatable about the axis of symmetry thereof, and said leading-edge stops and said front lay member including corresponding deflecting elements for producing a translatory displacement of said respective leading-edge stop in direction of said axis due to rotation about said axis.

2. The combination according to claim 1, wherein said front lay member is formed with a stop for limiting an adjustment path of each of said leading-edge stops with respect to said front lay member in said direction counter to said conveying direction, said leading-edge stops, in said alignment position of said front lay member being in said engaged position for aligning the leading edge of the sheet, when said leading-edge stops are in engagement with said respective stop formed on said front lay member.

3. The combination according to claim 1, wherein said axially symmetrical leading-edge stops have a peripheral surface formed with regions for introducing force for effecting a rotational adjustment.

4. The combination according to claim 1, wherein said axially symmetrical leading-edge stops have a peripheral surface formed with static friction surface regions.

5. The combination according to claim 4, wherein said static friction surface regions are selected from the group consisting of knurled and rubber-covered surface regions.

6. The combination according to claim 1, wherein said adjustment means include screws formed with an external thread corresponding to an internal thread formed in said front lay member, and said leading-edge stops are respective heads of said screws.

7. The combination according to claim 1, wherein said adjustment means include a pin, one of said adjustment means and said front lay member being formed with an axial cam, and the other of said adjustment means and said front lay member having a cam-follower element corresponding to said axial cam.

8. The combination according to claim 1, wherein said adjustment means includes a nut formed with an internal thread, and including an external screw thread formed on said front lay member, said internal thread corresponding to said external screw thread.

9. The combination according to claim 1, wherein said leading-edge stop is formed with profiling for engagement by a tool.

10. The combination according to claim 1, wherein said leading-edge stops are formed with means for axial position determination.

11. On a feeder table of a sheet-processing machine, the combination comprising a front lay member cyclically swivelable about an axis, in accordance with a sheet-conveying cycle, and leading-edge stops for effecting an alignment of paper sheets, said leading-edge stops being disposed on and swivelable with said front lay member out of an alignment position, into a rest position and back into said alignment position, each of said leading-edge stops being adjustment means for adjustably fastening said respective leading-edge stop in a respective position thereof in a conveying and counter to a conveying direction, respectively, of the paper sheets with respect to said front lay member in said alignment position of said front lay member, said adjustment means including a sheet abutting surface formed on each of said leading-edge stops, and means for guiding over said leading-edge stops a respective paper sheet pulled from the feeder table, said guiding means including at least one sheet-guiding roller.

12. On a feeder table of a sheet-processing machine, the combination comprising a front lay member cyclically swivelable about an axis, in accordance with a sheet-conveying cycle, and leading-edge stops for effecting an alignment of paper sheets, said leading-edge stops being disposed on and swivelable with said front lay member out of an alignment position, into a rest position and back into said alignment position, each of said leading-edge stops being adjustment means for adjustably fastening said respective leading-edge stop in a respective position thereof in a conveying and counter to a conveying direction, respectively, of the paper sheets with respect to said front lay member in said alignment position of said front lay member, said adjustment means including a sheet abutting surface formed on each of said leading-edge stops, and a cover lay fastened on said front lay member in vicinity of said leading-edge stops, said cover lay being formed with a sheet-guiding surface for guiding over said leading-edge stops a respective paper sheet pulled from the feeder table, said cover lay being formed with a pass-through opening providing access for adjusting said leading-edge stops.

13. On a feeder table of a sheet-processing machine, the combination comprising a front lay member cyclically swivelable about an axis, in accordance with a sheet-conveying cycle, and leading-edge stops for effecting an alignment of paper sheets, said leading-edge stops being disposed on and swivelable with said front lay member out of an alignment position, into a rest position and back into said alignment position, each of said leading-edge stops being adjustment means for adjustable fastening said respective leading-edge stop in a respective position thereof in a conveying and counter to a conveying direction, respectively, of the paper sheets with respect to said front lay member in said alignment position of said front lay member, said adjustment means including a sheet abutting surface formed on each of said leading-edge stops, and each of said leading-edge stops is a sliding element, and including corresponding deflecting elements on said front lay member and on said leading-edge stop for producing a translatorial displacement component of said leading-edge stop in the sheet conveying direction when said leading edge stops are slid substantially transversely to the sheet conveying direction.

* * * * *

UNITED STATES PATENT AND TRADEMARK OFFICE

CERTIFICATE OF CORRECTION

PATENT NO. : 5,496,023

DATED : March 5, 1996

INVENTOR(S) : Willi Becker, Stefan Doepke

It is certified that error appears in the above—identified patent and that said Letters Patent is hereby corrected as shown below:

On title page, Item (73)

"Heidelberber Druckmaschinen AG"

should read

-- Heidelberger Druckmaschinen AG --

Signed and Sealed this

Thirteenth Day of August, 1996

*Attest:*

*Attesting Officer*

BRUCE LEHMAN

*Commissioner of Patents and Trademarks*